US008981887B1

(12) United States Patent
Erlandsson

(10) Patent No.: US 8,981,887 B1
(45) Date of Patent: Mar. 17, 2015

(54) MAGNETIC TOOL AND PART HOLDER AND METHOD OF MAKING THE SAME

(71) Applicant: Alexander Erlandsson, Lynnwood, WA (US)

(72) Inventor: Alexander Erlandsson, Lynnwood, WA (US)

( * ) Notice: Subject to any disclaimer, the term of this patent is extended or adjusted under 35 U.S.C. 154(b) by 184 days.

(21) Appl. No.: 13/750,363

(22) Filed: Jan. 25, 2013

(51) Int. Cl.
*H01F 7/20* (2006.01)
*H01F 7/02* (2006.01)

(52) U.S. Cl.
CPC ..... *H01F 7/0236* (2013.01)
USPC ..... 335/285; 335/303; 335/306

(58) Field of Classification Search
USPC ..... 335/285–295, 303, 306; 224/183; 206/350; 269/8
See application file for complete search history.

(56) References Cited

U.S. PATENT DOCUMENTS 8,174,347 B2 * 5/2012 Fullerton et al. ..... 335/306
2003/0230606 A1 * 12/2003 Devinie ..... 224/183

* cited by examiner

*Primary Examiner* — Ramon Barrera
(74) *Attorney, Agent, or Firm* — Timothy E. Siegel Patent Law, PLLC; Timothy E. Siegel

(57) ABSTRACT

A magnetic tool-holder, comprising a flexible outer web defining an enclosed area and enclosing an array of solid, rigid magnets. The magnets are regularly interspersed in direction of polarization, so that the nearest neighbors of a magnet having a north pole facing in a first direction all have a north pole facing in a second direction, opposite to the first direction.

2 Claims, 4 Drawing Sheets

MAGNETIC TOOL AND PART HOLDER AND METHOD OF MAKING THE SAME

BACKGROUND

The present invention is in the field of magnetic tool holders. In the prior art, U.S. Pat. No. 4,826,059, issued to Bosch et al. shows a tool belt having an array of rectangular magnets for holding tools and parts in an easily accessible manner on the front of the belt. This patent mentions attaching the toolholder to a "magnetically responsive objects or surfaces." Because of the longitudinal extent of the magnets, however, the belt would not conform along that extent unless the magnets were flexible. Flexible magnets tend to be less powerful than rigid magnets.

Also, published application no. 2004/0173484 discloses a magnetic tool-holder in which a loose array of magnets is sewn into individual pockets. Such a loose array will not tend to provide a powerful enough magnetic force to hold larger tools and to stay on a metal car surface when loaded down with an array of heavy tools and parts. Also, although this application discloses arranging the magnets with random polarization, such random polarization would tend not to produce the maximum magnetic force.

SUMMARY

The following embodiments and aspects thereof are described and illustrated in conjunction with systems, tools and methods which are meant to be exemplary and illustrative, not limiting in scope. In various embodiments, one or more of the above-described problems have been reduced or eliminated, while other embodiments are directed to other improvements.

In a first separate aspect, the invention may take the form of a magnetic tool-holder, having a flexible outer web defining an enclosed area and enclosing an array of elliptical, solid, rigid magnets. The magnets cover over 30% of the enclosed area.

In a second separate aspect, the invention may take the form of a method of making a magnetic tool-holder, starting with a web of flexible material placed on a web of magnetically responsive material and then placing the magnets on the web of flexible material, whereby the engagement of the magnets and the web of magnetically responsive material holds the magnets in place, despite magnetic forces between the magnets. Then, the magnets are enclosed in the flexible material.

In a third separate aspect, the invention may take the form of a magnetic tool-holder, comprising a flexible outer web defining an enclosed area and enclosing an array of solid, rigid magnets. The magnets are regularly interspersed in direction of polarization, so that the nearest neighbors of a magnet having a north pole facing in a first direction all have a north pole facing in a second direction, opposite to the first direction.

In addition to the exemplary aspects and embodiments described above, further aspects and embodiments will become apparent by reference to the drawings and by study of the following detailed descriptions.

BRIEF DESCRIPTION OF THE DRAWINGS

Exemplary embodiments are illustrated in referenced drawings. It is intended that the embodiments and figures disclosed herein are to be considered illustrative rather than restrictive.

DETAILED DESCRIPTION

Figure 1:
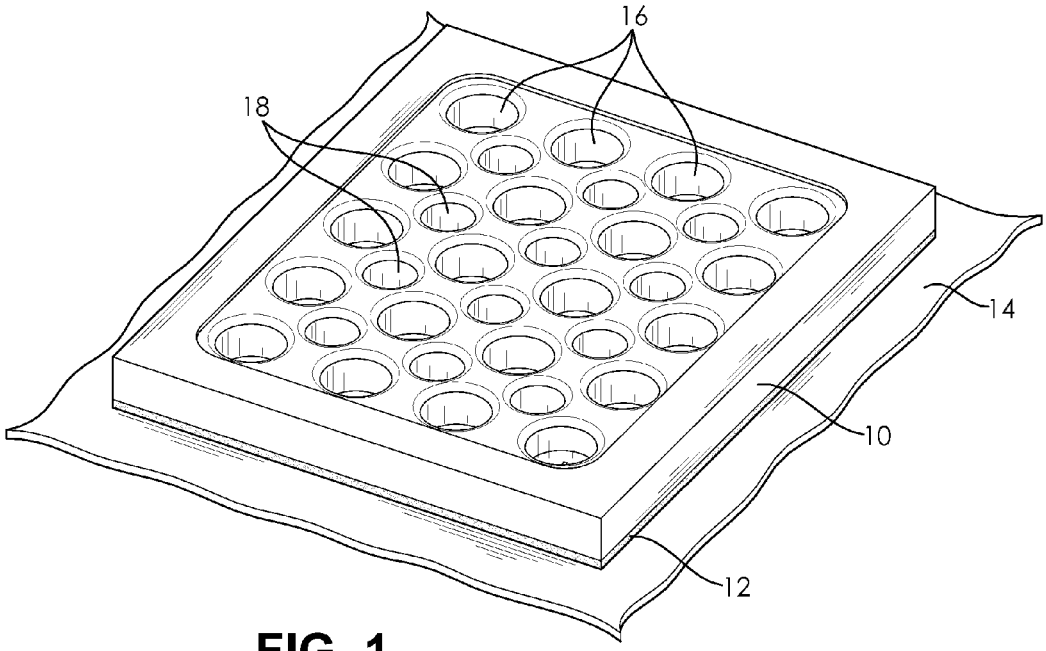
FIG. 1 shows the first step in a production process of a magnetic tool holder, according to the present invention.
Figure 2:
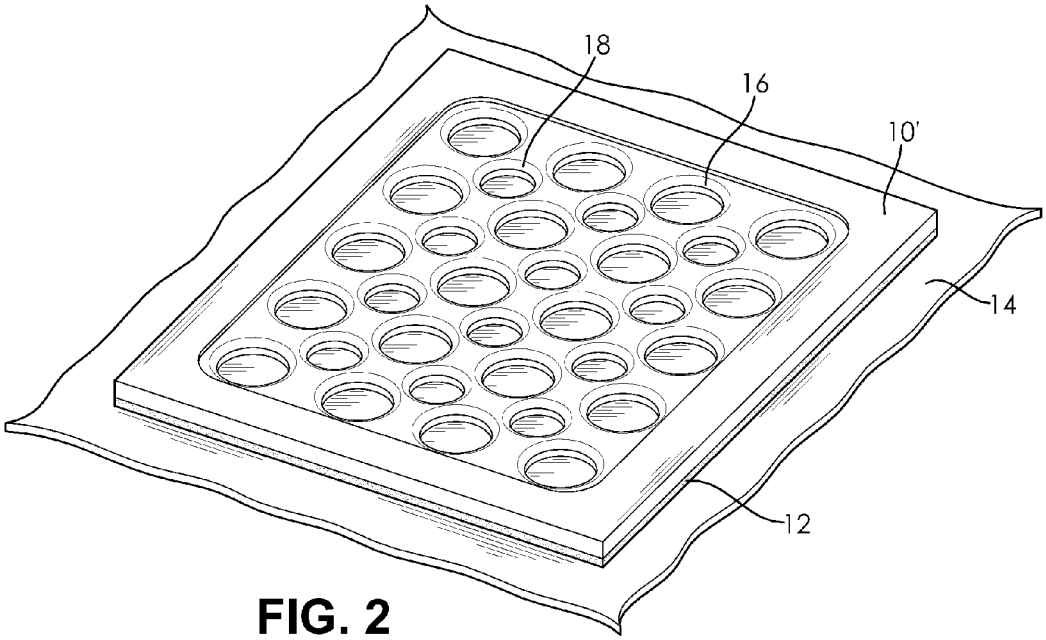
FIG. 2 shows the first step in an alternative production process of a magnetic tool holder, according to the present invention.
Figure 3:
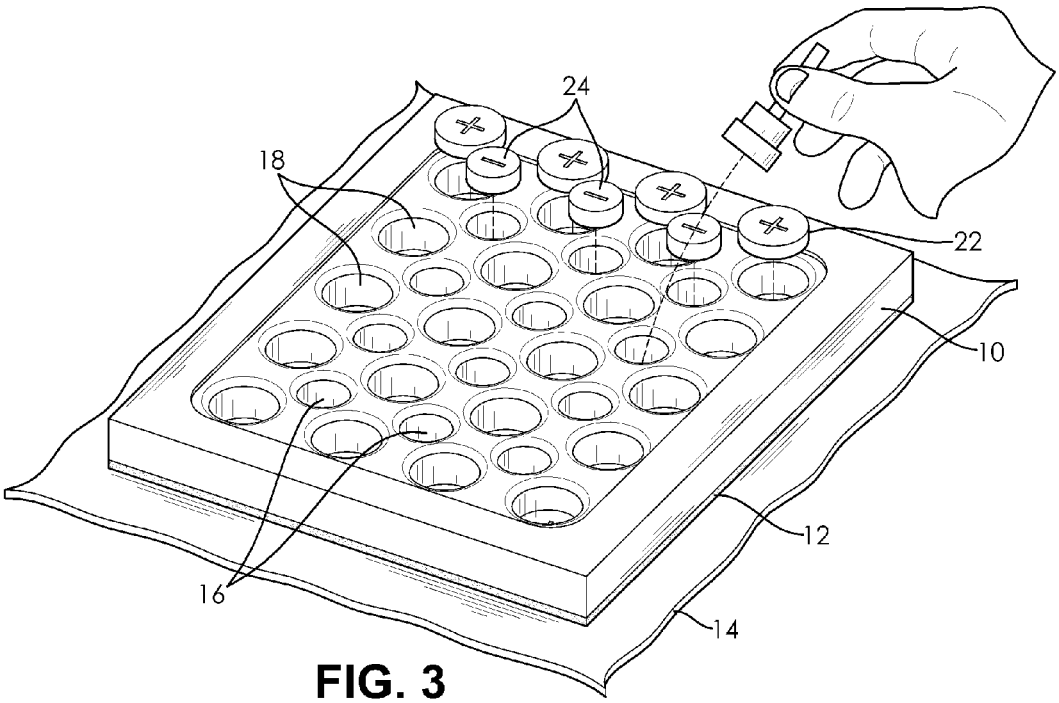
FIG. 3 shows a further step of the production process of FIG. 1.
Figure 4:
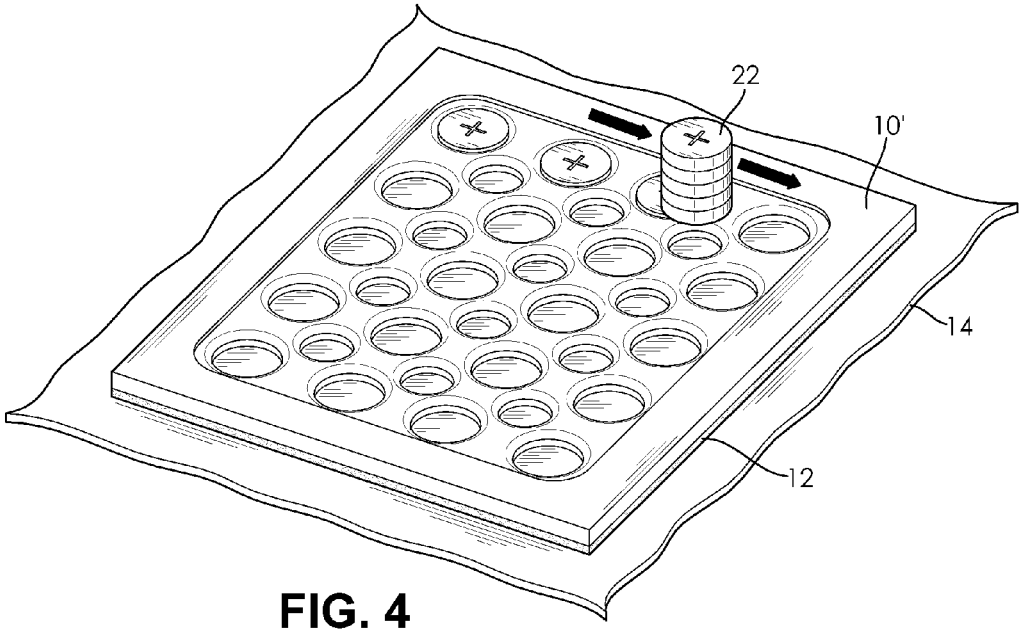
FIG. 4 shows a further step of the production process of FIG. 2

Referring to FIG. 1, in one preferred embodiment a method of producing a magnetic tool holder begins with a template 10, set atop a piece of web material, such as a flexible sheet 12 having an adhesive surface 13 (FIG. 5), set in turn on a sheet 14 of magnetically responsive material, such as steel. Template 10 defines a regular series of large through-holes 16, and smaller through-holes 18 that are interspersed diagonally. Turning to FIG. 3, a person may now use a tool to place large magnets 22 and smaller magnets 24 (FIG. 5) in each of the through-holes 16 and 18, respectively, so that they rest on adhesive surface 13. Referring to FIGS. 2 and 4, in an alternative preferred method, a thinner template 10' is used, and the magnets 22 may be placed in a stack and for each hole 16, a single magnet 22 is placed inside and then separated from the stack by shearing the stack 26 away from the magnet 22, as shown. The same process may be performed with respect to magnets 24 and holes 18.

Figure 5:
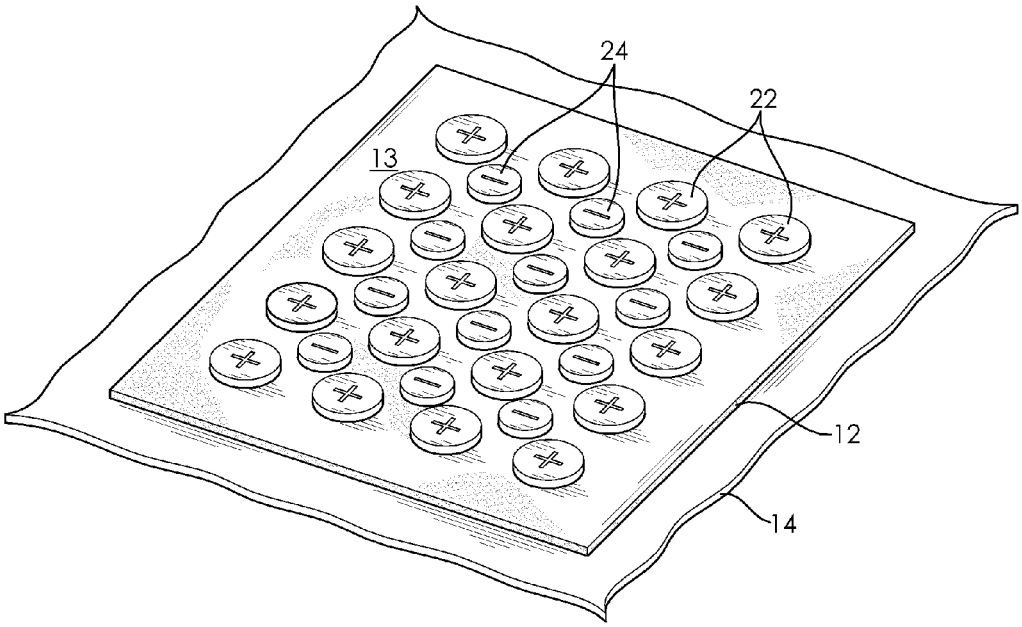
FIG. 5 shows a partially completed magnetic tool holder, according to the present invention.

Referring to FIG. 5, when template 10 or 10' is removed, the strength of the magnetic attraction between magnets 22 and 24 and magnetically responsive sheet 14 keeps the magnets from being drawn together, which would disturb the positioning. As shown, in a preferred embodiment the small magnets 24 are all oriented with their polarities 180 degrees from the polarities of the large magnets 22. In an alternative preferred embodiment large magnets are interspersed in polarity, so that across a row a first large magnet 22 would have its plus pole on top (in the dimensions of FIG. 5) and the next large magnet 22 would have its minus pole on top. The small magnets 24 could be similarly interspersed. In another preferred embodiment the magnets are all the same size, but arranged so that their polarities are regularly interspersed. Although the drawings show these operations being performed by hand, they could be automated and performed by a machine, without falling outside of the scope of the invention.

Figure 6:
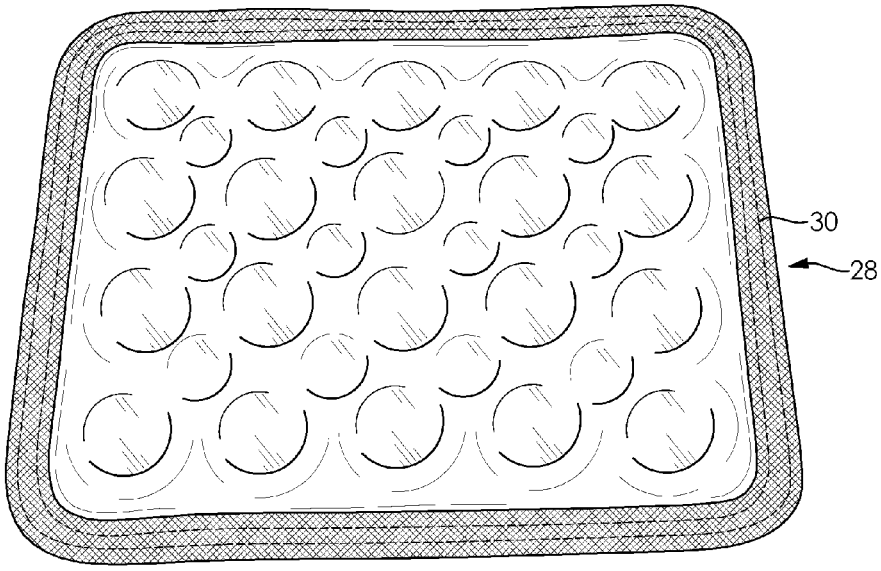
FIG. 6 shows a completed magnetic tool holder, according to the present invention.

Finally FIG. 6 shows the finished product 28 made by providing another sheet 14 also having an adhesive surface and placing it so that the adhesive surface contacts magnets 22 and 24 and also mutually adhering both sheets 14 together. In one preferred embodiment sheets 14 and 14' are all part of a larger sheet which is folded over about magnets 22 and 24. Finally, sheets 14 and 14' are sewn together at their margins, with some backing material 30 added to buttress the seam. In a further preferred embodiment, grommets, loops, or other features to more easily permit the tool holder 28 to be hung on a hook, are provided. Moreover, pockets and/or other convenience or safety features could be added to tool holder 28, without departing from the scope of the invention.

Figure 7:
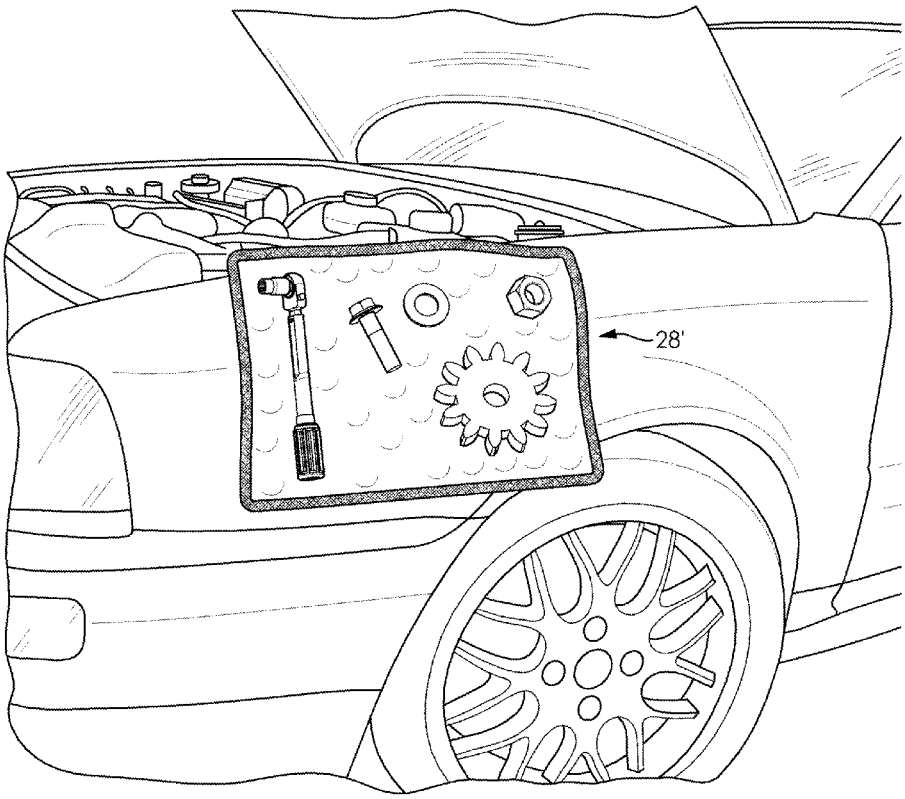
FIG. 7 shows a completed magnetic holder affixed to a metal car surface.

In use, as shown for one embodiment in FIG. 7, the device 28' provides a powerful magnetic force that can hold even quite heavy pieces in place. With respect to the device 28, the close spacing of magnets 22 and 24 made possible in part by the differing sizes, helps to create a powerful magnetic force, which is also made possible by the regularly interspersed polarity of the magnets 22 and 24, which greatly increases the magnetic force when magnetically attached to a magnetically responsive material, as opposed to all the magnets having the same polarity, or the magnets having random polarization.

In one preferred embodiment, magnets 22 and 24 are hard ferrite magnets. Not only is this type of magnet relatively inexpensive, but it also has high coercivity and remanence, desirable qualities in the present application, where they may be used for years, without losing significant magnetic force. In a preferred embodiment, large magnets 22 are 1"×⅕" (one inch by one-fifth inch), and the small magnets 24 are ¾"×⅕" (three-quarters inch by one-fifth inch). In a preferred embodiment the circular edges of magnets 22 and 24 are rounded.

While a number of exemplary aspects and embodiments have been discussed above, those possessed of skill in the art will recognize that certain modifications, permutations, additions and sub-combinations thereof exist. It is therefore intended that the following appended claims and claims hereafter introduced are interpreted to include all such modifications, permutations, additions and sub-combinations as are within their true spirit and scope.

The invention claimed is:

1. A magnetic tool holder, comprising a flexible outer web defining an enclosed area and enclosing an array of solid, rigid magnets, and wherein said magnets of either a first size or a second size and are regularly interspersed in direction of polarization and in size, so that the nearest neighbors of a magnet having a north pole facing in a first direction all have a north pole facing in a second direction, opposite to said first direction and wherein for each magnet of said first size all of said nearest neighbor magnets are of said second size.

2. The magnetic tool holder of claim 1, wherein said flexible outer web includes an inner surface that is adhesive and wherein said magnets are adhered to said flexible outer web adhesive inner surface.

* * * * *